US005973465A

United States Patent [19]

Rayner

[11] Patent Number: 5,973,465

[45] Date of Patent: Oct. 26, 1999

[54] AUTOMOTIVE RESTART CONTROL FOR SUBMERSIBLE PUMP

[75] Inventor: Mark D. Rayner, Houston, Tex.

[73] Assignee: Toshiba International Corporation, Houston, Tex.

[21] Appl. No.: 09/066,974

[22] Filed: Apr. 28, 1998

[51] Int. Cl.[6] ..... F04B 49/10

[52] U.S. Cl. ..... 318/459; 417/18

[58] Field of Search ..... 318/445, 449, 318/450, 459, 461, 705; 361/3; 417/1, 18, 44.1

[56] References Cited

U.S. PATENT DOCUMENTS 3,875,463 4/1975 Reuter et al. .
4,103,316 7/1978 Kaneko ..... 361/3
4,438,383 3/1984 Etheridge ..... 318/799
5,475,292 12/1995 Nakanishi et al. ..... 318/705

*Primary Examiner*—Bentsu Ro
*Attorney, Agent, or Firm*—Banner & Witcoff, Ltd.

[57] ABSTRACT

A method for restarting a motor of a submersible pump after a power interruption is disclosed. The system first detects when the power is turned back on to the system. A control means then samples signals sent back from the unpowered motor and determines the frequency and phase sequence of the signals. The speed and direction of operation of the motor are then determined from the determined frequency and phase sequence. A first pulse width modulation waveform is then applied to the motor matching the determined speed and direction of the motor. Finally, the output frequency of the waveform can be adjusted to adjust the speed and direction of operation of the motor until the motor reaches a desired speed and direction of operation.

8 Claims, 4 Drawing Sheets

AUTOMOTIVE RESTART CONTROL FOR SUBMERSIBLE PUMP

FIELD OF THE INVENTION

The invention relates to a method and apparatus for controlling the operations of a motor, and more particularly to a method and apparatus for automatically restarting a motor/pump assembly after a power interruption.

BACKGROUND OF THE INVENTION

In the production of oil, a well is drilled down to an oil bearing strata. At the bottom of the well, a motor/pump assembly is installed to pump the oil to the surface of the earth from the pool that gathers at the bottom of the well. FIG. 1 illustrates a typical oil well assembly. A well 10 is drilled into the earth perhaps thousands offeet down to an oil bearing strata. A motor 14 which drives a pump 16 are lowered to the bottom of the well. The motor 14 is electrically connected by a cable 22 to a drive system 20, typically located outside the well, which provides drive signals to the motor 14. The drive signals control the operation of the motor 14 which in turn controls the operations of the pump 16. When the motor 14 is turned on, the motor turns the pump 16 so that oil is drawn out of the bottom of the well and up the pipe 18 to the surface creating a positive flow 24.

One concern in the oil industry is the amount of time an oil well is not operating because of a physical or mechanical problem. The downtime of the pump reduces the production capability of the well. One source of downtime occurs when there is a power interruption to the system caused by a power outage, blown circuit breaker, controlled stop or the like. When a power interruption occurs, the drive system loses control of the motor because control signals can no longer be sent to the motor. Even though the motor is now unpowered, the motor and pump will continue to operate for at least a certain period of time depending on how fast the motor was turning at the time the power was interrupted. The speed of the motor will slowly decrease until the motor and pump come to a complete stop.

One problem unique to oil well applications and submersible pumps is that when the pump stops there is a column of oil, for example 4000 feet tall, resting on top of the pump. The column of oil will begin falling back to the bottom of the well due to gravity. As the oil falls back, the oil exerts pressure on the pump causing the pump to work in the opposite direction, i.e. a negative flow. In turn, the pump will cause the motor to rotate in an opposite direction and at varying speeds as the entire column of oil falls to the bottom of the well. As a result, when the power to the motor is interrupted, the motor will operate at different speeds and even in different directions depending on the length of the power interruption.

Since a motor can be damaged or a circuit will be tripped in the drive system if the motor receives an initial drive signal which is different from the actual speed and direction of operation of the motor, oil well operators have to wait until they are certain that the entire column of oil as fall back to the bottom of the well and the motor has come to a complete stop before they can send drive signals to restart the motor after the power interruption is over. This creates a tremendous amount of downtime regardless of how long the power interruption lasts.

Thus, there is a need for a control system which is capable of automatically restarting a motor of a submersible pump after a power interruption without having to wait for the motor to come to a complete stop.

Automatic restart programs are known for other applications, such as devices which include a driveable centrifuge. A centrifuge is used to separate solids in liquid samples by spinning the sample around a circle at high speeds. When the power is cut off to the motor in the centrifuge, the momentum and weight of the centrifuge will keep the samples spinning at decreasing speeds until the centrifuge comes to a complete stop due to friction and other forces. One known control system can restart the motor after the power is turned back on by first determining the actual speed of the unpowered motor and applying drive signals to the motor that match the actual speed of the motor. This is performed by analyzing the back EMF signals produced by the motor's residual magnetism created by the unpowered spinning motion of the motor. Once the speed of the motor has been determined, the matching drive signals are sent to the motor to regain control of the centrifuge and additional control signals can be applied to change the centrifuge's speed to a desired level. Thus, the operator does not have to wait for the centrifuge to come to a complete stop before restarting the motor after a power interruption.

SUMMARY OF THE INVENTION

It is an object of the invention to overcome the problems associated with restarting submersible pumps after a power failure or interruption by providing a control system which can determine the speed and direction of operation of the unpowered submersible pump.

According to one embodiment of the invention, a method for restarting a motor of a submersible pump after a power interruption is disclosed. The system first detects when the power is turned back on to the system. A control means then samples signals sent back from the unpowered motor and determines the frequency and phase sequence of the signals. The speed and direction of operation of the motor are then determined from the determined frequency and phase sequence. A first pulse width modulation waveform is then applied to the motor matching the determined speed and direction of the motor. Finally, the output frequency of the waveform can be adjusted to adjust the speed and direction of operation of the motor until the motor reaches a desired speed and direction of operation.

According to another embodiment of the invention, a system for automatically restarting a motor after a power interruption is disclosed. A pump is connected to and driven by the motor, and the motor and the pump are located in a well. A cable connects the motor to an adjustable speed motor drive via a transformer so that signals can pass back and forth from the motor and the adjustable speed motor drive. The adjustable speed motor drive comprises several elements such as means for receiving signals from said motor before power is returned to the motor; means for determining frequency and phase sequence of the signals; means for determining speed and direction of operation of the motor from the determined frequency and phase sequence; means for generating a first modulation waveform which matches the determined speed and direction of operation of the motor; and means for transmitting the first modulation waveform to the motor through the cable. The output frequency of the waveform can then be adjusted to adjust the speed and direction of operation of the motor until the motor reached a desired speed and direction of operation.

BRIEF DESCRIPTION OF THE DRAWINGS

The present invention will be more fully described by way of example, with reference to the accompanying drawings, in which.

DETAILED DESCRIPTION

The invention will now be described with reference to pumps used in oil wells. However, one skilled in the art will understand that the invention can also be used in a variety of submersible pump applications.

Figure 1:
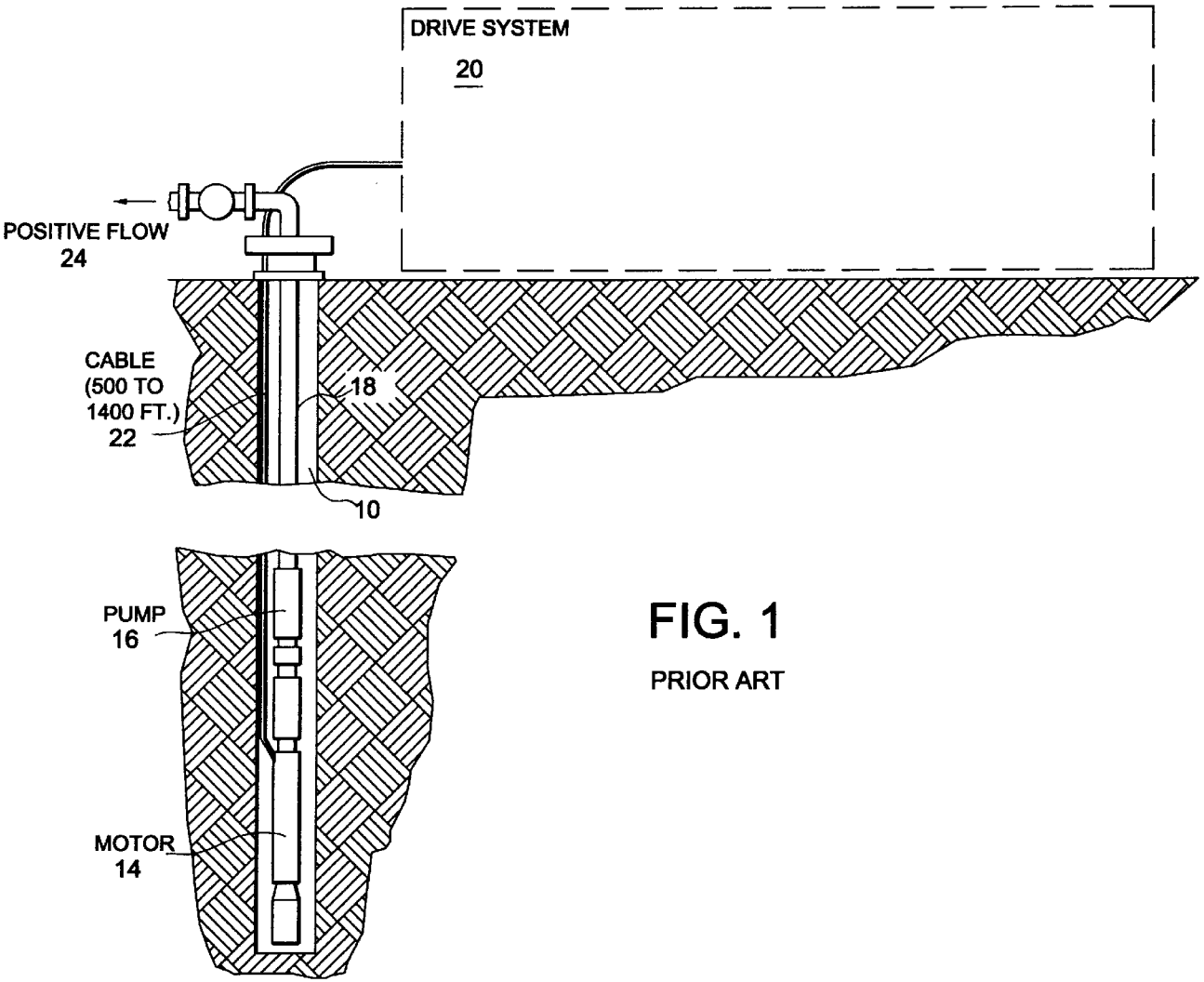
FIG. 1 PRIOR ART
FIG. 1 is a block diagram of a typical oil well assembly.
Figure 2:
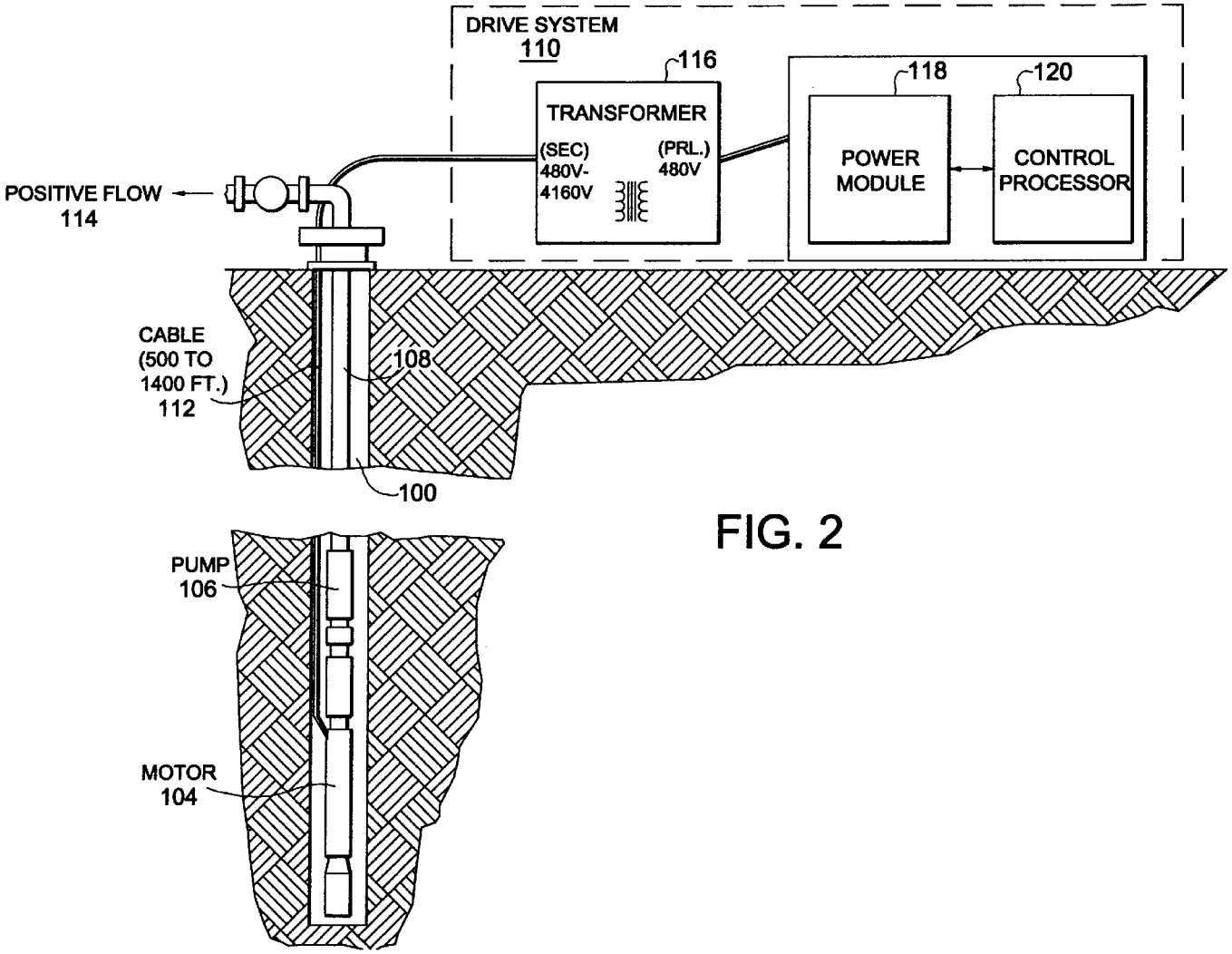
FIG. 2 is a block diagram of a submersible pump system with automatic restart capabilities according to an embodiment of the present invention.

FIG. 2 illustrates an oil well pumping assembly according to one embodiment of the invention. A well 100 is drilled into the earth perhaps thousands of feet down to an oil bearing strata. A motor 104 which drives a pump 106 are lowered to the bottom of the well. The motor 104 is electrically connected by a cable 112 to a drive system 110, typically located outside the well, which provides drive signals to the motor 104. The drive signals control the operation of the motor 104 which in turn controls the operations of the pump 106. When the motor 104 is turned on, the motor turns the pump 106 so that oil is drawn out of the bottom of the well and up the pipe 108 to the surface creating a positive flow 114.

The adjustable speed drive system 110 comprises at least a transfomer 114, a power module 118 and a control processor 120. The primary windings of the transformer 114 are connected to the power module 118 and the power module 118 is connected to the control processor 120. The control processor 120 can also be implemented as a part of the power module 118. The secondary windings of the transformer 114 are connected to the cable 112. Thus, modulation waveforms such as pulse width modulation (PWM) waveforms and power are generated by the power module and the control process 120 and applied to the transformer 114. The transformer 114 transforms the signals to the appropriate power level and transmits the signals to the motor 104 through the cable 112.

When a power interruption occurs, the drive system 110 loses power and PWM waveforms can no longer be sent to the motor. When the power comes back on, the drive system does not know how fast and in what direction the unpowered motor is operating. Furthermore, as described above, restarting the motor at the wrong speed or direction of operation can damage the motor or cause a circuit breaker to trip in the drive system. Thus, the invention determined the speed and the direction of operation of the unpowered motor before restarting the system.

Unless the unpowered motor is in a stopped position, the rotation of the motor will create back EMF signals from the motor's residual magnetism. These back EMF signals travel through the cable 112 and are detected by the drive system 110 once the power is restored to the drive system 110.

Figure 3:
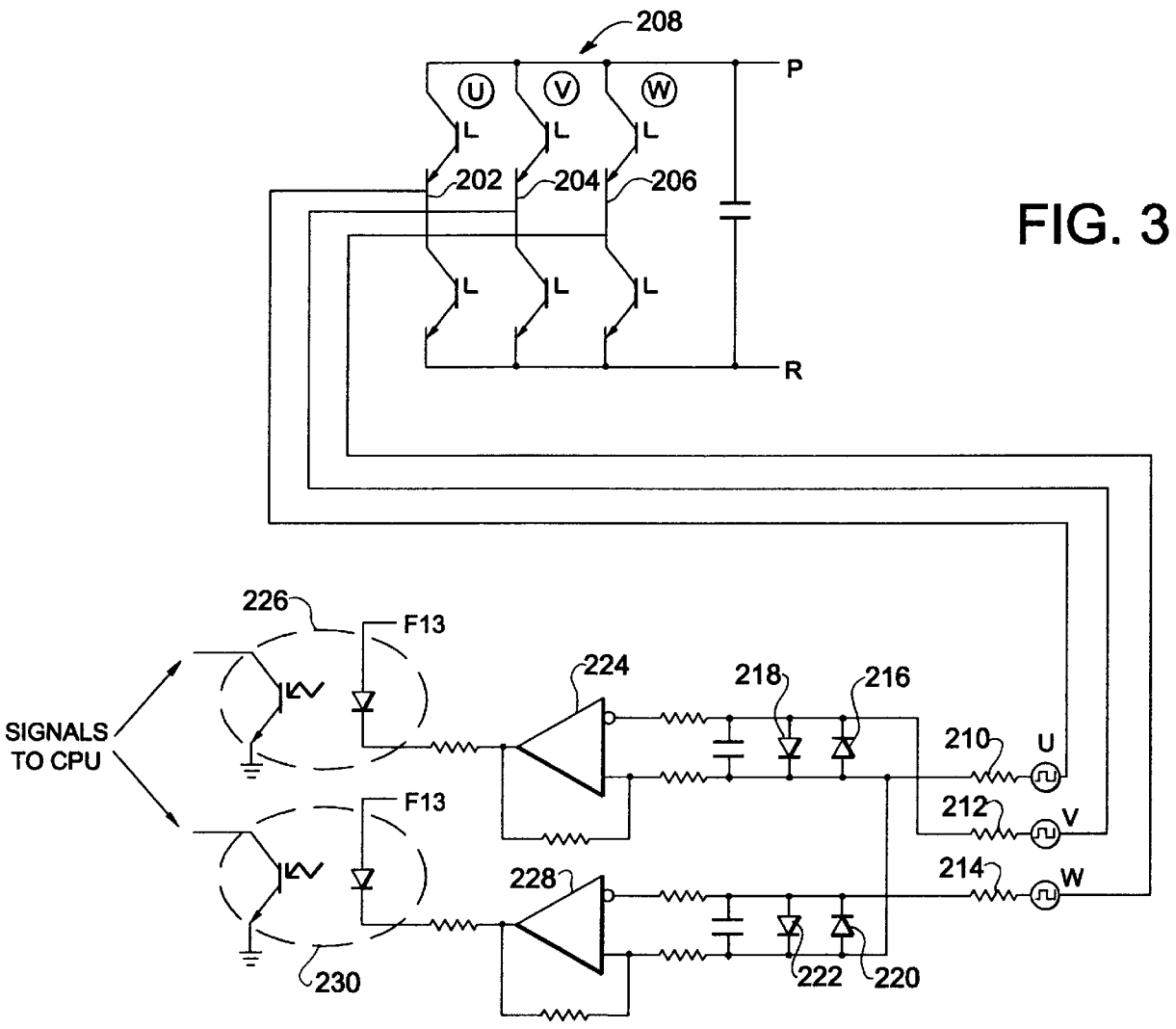
FIG. 3 is a section of the circuit of the power module according to one embodiment of the present invention.
Figure 4:
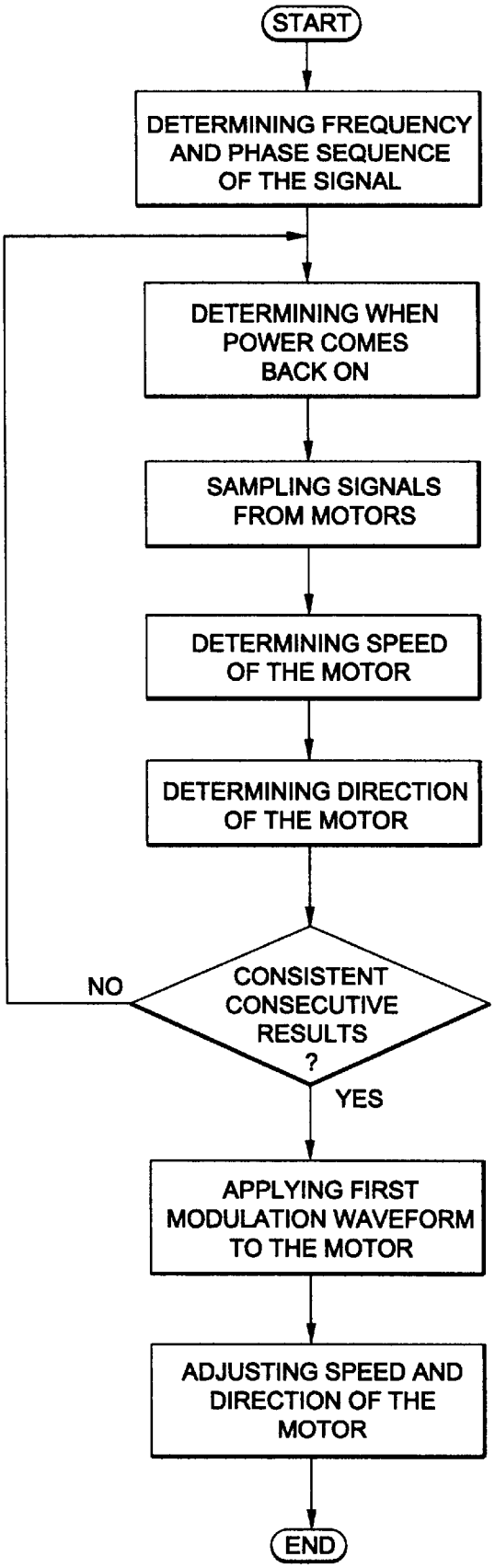
FIG. 4 is a flow chart illustrating the automatic restart capabilities of one embodiment of the present invention.

The operation of the drive system 110 will now be described with reference to FIGS. 3 and 4. The drive system samples the frequency of the EMF signals at the drive terminals 202,204,206 of an IGBT bridge 208 of the three phase (U,V,W) power module. The sampled signals of the three drive terminals are fed through resistors 210,212,214 respectively, to two comparator circuits. Two phases are fed to each comparator circuit. For example, as illustrated in FIG. 3, phases U and V are fed to the top comparator circuit and phases U and W are fed to the bottom comparator circuit but the invention is not limited thereto. The signals are passed through clamping diodes 216,218 and 220,222 respectively to prevent the comparator from being driven too hard. If the V phase signal applied to the comparator 224 is stronger than the U phase signal, the comparator will turn on which will turn on the photocoupler 226. Likewise, if the U phase signal is stronger than the V phase signal, the comparator 224 will not turn on and the photocoupler 226 will not turn on. The lower comparator 228 operates in the same manner with the W and U phase signals. When the W phase signal is stronger than the U phase signal, the comparator 228 will turn on causing the photocoupler 230 to turn on.

The signals produced by the photocouplers 226 and 230 are then applied to the control processor 120. The control processor 120 determines the frequency of the signals from the photocouplers by counting the time between the edges of the signals. The control processor 120 determines the period of the signals produced by the photocouplers to determine the speed of the motor. The control processor 120 then determines which phase is the leading phase by determining the order in which the photocouplers 226 and 230 are being activated. From the determined leading edge, the control processor can determine the direction of operation of the motor.

As a means for ensuring that the period and thus the speed of the motor is correctly known, the control processor waits until it has received at least two and preferably three or more consistent readings before attempting to regain control of the motor. Once the control processor has received consistent readings, the control processor and power module generate a modulation waveform such as a pulse width modulation waveform approximately matching the detected speed and direction of operation of the motor. The modulation waveform is then sent to the motor, thus reestablishing control of the motor. Once control has been reestablished, the control processor and power module can modify the output frequency of the modulation waveform to return the motor to the desired speed and direction of operation.

The invention, therefore, is well adapted to monitor and control a submersible pumping motor and carry out the objects and provide the advantages mentioned as well as others which would be understood to one skilled in the art. Although a preferred embodiment of the invention has been detailed for the purpose of disclosure, numerous changes or arrangement of components may be made without departing from the spirit of the invention and the scope of the appended claims.

I claim:

1. A system for automatically restarting a motor after a power interruption, comprising:

a pump connected to and driven by the motor, said motor and pump being located in a well;

a cable connecting said motor to an adjustable speed motor drive via a transformer so that signals can pass back and forth from said motor and an adjustable speed motor drive;

said adjustable speed motor drive comprising means for receiving signals from said motor before power is returned to the motor;

means for determining frequency and phase sequence of said signals;

means for determining speed and direction of operation of the motor from said determined frequency and phase sequence;

means for generating a first modulation waveform which matches the determined speed and direction of operation of the motor; and means for transmitting the first modulation waveform to the motor through the cable, wherein an output frequency of said waveform is adjusted to adjust the speed and direction of operation of the motor until the motor reached a desired speed and direction of operation.

2. The system according to claim 1, wherein said signals sent back from said unpowered motor are generated by the rotation of the motor's rotor excited by residual magnetism in the motor.

3. The system according to claim 1, wherein said adjustable speed motor drive waits until at least a predetermined number of consecutive results of the determination of speed and direction of operation are consistent before generating said first modulation waveform.

4. The system according to claim 3, wherein said predetermined number is equal to three.

5. The system according to claim 1, wherein said signals sent back from said unpowered motor are generated by the pressure on the pump exerted by a falling column of liquid.

6. The system according to claim 1, wherein said motor and pump are located in an oil well.

7. The system according to claim 1, wherein the speed of the motor is determined from a period of the signals sent back from the unpowered motor.

8. The system according to claim 1, wherein the direction of the motor is determined by sampling two phases of the signals sent back from the unpowered motor.

* * * * *

UNITED STATES PATENT AND TRADEMARK OFFICE

CERTIFICATE OF CORRECTION

PATENT NO. : 5,973,465

DATED : October 26, 1999

INVENTOR(S) : Mark D. Rayner

It is certified that these errors appear in the above-identified patent and that said Letters Patent is hereby corrected as shown below:

Item [54], Title of Invention,

"AUTOMOTIVE RESTART CONTROL FOR SUBMERSIBLE PUMP" has been replaced with --AUTOMATIC RESTART CONTROL FOR A SUBMERSIBLE PUMP--.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*